US008733089B2

(12) United States Patent
Barbetti et al.

(10) Patent No.: US 8,733,089 B2
(45) Date of Patent: May 27, 2014

(54) FLUID-DYNAMIC CIRCUIT

(75) Inventors: Mauro Barbetti, Correggio (IT); Gianfranco Pellacani, Correggio (IT)

(73) Assignee: Teco S.R.L., Correggio (RE) (IT)

( * ) Notice: Subject to any disclaimer, the term of this patent is extended or adjusted under 35 U.S.C. 154(b) by 826 days.

(21) Appl. No.: 12/950,113

(22) Filed: Nov. 19, 2010

(65) Prior Publication Data

US 2011/0114209 A1 May 19, 2011

(30) Foreign Application Priority Data

Nov. 19, 2009 (IT) ..... M02009A0275

(51) Int. Cl.
*F15D 1/00* (2006.01)

(52) U.S. Cl.
USPC ..... 60/468; 60/494; 157/1.17

(58) Field of Classification Search
USPC ..... 60/413, 494, 468; 91/420, 392; 157/1.46, 1.17
See application file for complete search history.

(56) References Cited

U.S. PATENT DOCUMENTS

| | | | | |
|---|---|---|---|---|
| 2,945,522 | A | 7/1960 | Nelson | |
| 2003/0167914 | A1* | 9/2003 | Arai | 91/392 |
| 2006/0201321 | A1* | 9/2006 | Loedige et al. | 91/420 |

FOREIGN PATENT DOCUMENTS

| | | | |
|---|---|---|---|
| EP | 1155880 A2 | * | 11/2001 |
| FR | 1400535 | | 5/1965 |
| FR | 1400535 | * | 5/1967 |
| FR | 2142593 | | 2/1973 |
| FR | 2343145 | | 9/1977 |
| JP | 5087304 U | | 11/1993 |

OTHER PUBLICATIONS

Italian Ministry of Economic Development, Research Report, EPO Munich, Jul. 20, 2010.

* cited by examiner

*Primary Examiner* — Ned Landrum
*Assistant Examiner* — Logan Kraft
(74) *Attorney, Agent, or Firm* — Themis Law

(57) ABSTRACT

A fluid-dynamic circuit includes a source of a pressurized fluid; a distributor valve for distributing the pressurized fluid to transport lines; a feeding line for feeding the pressurized fluid, which is interposed between the source and the valve; a main user apparatus, which is reciprocatingly operated by an actuator that includes a slider sealably fitted in a sliding seat of a containing element divided thereby into a first chamber and a second chamber in opposite positions and having variable volumes; and second and third transport lines for the pressurized fluid, which are interposed between the distributor valve and the first and second chamber respectively, a first derived transport line being interposed between the valve and at least one of the second and third transport lines, and having a normally closed quick discharge device mounted thereto, whose opening is designed to be controlled by the actuator.

14 Claims, 11 Drawing Sheets

FLUID-DYNAMIC CIRCUIT

FIELD OF INVENTION

The present invention relates to a fluid-dynamic circuit, particularly adapted to control the movements of drive members for driving implements and tools on operating machines, such as tire demounting machines.

BACKGROUND OF THE INVENTION

Various technical fields use automatic or semiautomatic machines with tools mounted to the free end of an operating arm, which is movably attached to a support of the machine and moves with a single degree of freedom.

These tools shall be caused to contact an object upon which they are designed to operate, while ensuring that no excessive contact forces are generated between the tool and the object, to prevent any damage during such contact.

For this reason, it is highly advantageous to use detection means to detect the contact between the tool and the object to be acted upon, which detection means generally controls drives of additional automatic members that shall be only actuated when contact has occurred between the tool and the object.

A further very useful feature is the possibility of controlling the stroke and position of the arm and to cause it to reach a predetermined limit stop position which typically coincides with the contact between the tool and the object or with a predetermined position of the arm, to control the operation of the automatic members which, as mentioned above, shall be only operated once such limit stop position has been reached.

The tool supporting arm is typically driven by a double-acting fluid-dynamic actuator, which is interposed between the arm and the support of the machine in which the arm slides.

In order to obtain the above described features, the operation of the actuator must be controlled to limit the sliding speed of the piston in the jacket and the drive force that will be exerted on the object as contact occurs between the latter and the arm-supported tool.

Two possible alternative solutions are used in the prior art to control the arm stroke, and hence the action of the actuator.

In a first solution, one or more proximity sensors (selected from those known in the art) are mounted to the machine support, to the arm and, when needed, also to the tool.

Thus, a warning signal, typically an electric or pneumatic signal may be used to detect when the arm reaches the predetermined limit stop position, which signal is transmitted by the sensors to one or more control units of the machines, which are designed to control the operation of the automatic members.

Nevertheless, this first solution suffers from certain drawbacks.

A first drawback is that the areas in which the proximity sensors shall be mounted and positioned must be located and prepared on the arm support and possibly on the tool.

Furthermore, these operations shall be carried out in a particularly accurate manner, to avoid any inaccurate arm position detection.

A second drawback is that means have to be provided for transmitting and carrying signals from the sensors to the control unit, such as cables, pipes, optical fibers, and this involves an increase of machines' manufacturing costs, because in addition to sensor costs, seats have to be formed, by suitable processing, on the arm, the support and possibly the tool, for mounting such sensors.

Furthermore, if the sensor mounting positions are not easy to reach, the sensors must be calibrated according to their non-optimal location with respect to a limit stop position or the end position that the arm is required to reach.

A further drawback is that the sensors that are designed to generally detect a contact between a tool and an object upon which the latter is designed to act are typically mechanical sensors and hence clearances may exist between components that might cause inaccurate detections with respect to the positions that have been reached by the tool relative to the object.

Therefore, for improved accuracy, high-precision sensors must be used, which will have a proportionally higher cost.

A further drawback is that the lines that carry the signals between the sensors and the control unit are often mounted, at least partially, in the proximity of the object and this increases the risk of contact with the object or with parts that might come off therefrom during further processing.

In the second solution the arm is still moved by means of an actuator, but detection of a predetermined limit stop position of the arm occurs by measuring changes in the force of the actuator, namely by measuring the pressure thereof, which considerably increases above the normal operating value when the actuator is under a stress, because the arm and the tool have reached the limit stop position that stops any further sliding movement although the pushing action of the actuator continues.

Such second solution provides an advantage over the first solution, in that the lines required transmitting the signals indicating that the arm has reached its limit stop position or a predetermined position, are the lines that are used to connect the actuator to fluid source, also known as power source.

According to the second solution, a further parameter may be also used to detect that the arm has reached a limit stop position, i.e. the change in the energy (typically electric energy) absorbed by the actuator during normal operation and when the limit stop position has been reached; when this state is reached, energy absorption considerably increases due to the resistance opposed to the actuator.

Therefore, in short, this second solution is generally preferable, as long as pressure forces and changes thereof can be measured as the arm moves in its support.

Furthermore, this second solution has a much simpler construction than the first solution and hence, a lower cost and improved reliability with time.

However, this second solution also has various drawbacks.

A first drawback is that the speed of the arm relative to its support has to be controlled and limited, both to prevent kinetic reactions from causing the arm to slide beyond a predetermined end position with no limit stop abutment, and to allow accurate detection of the changes in pressure or (electric) force absorbed by the actuator.

Furthermore, the thrust imparted by the actuator shall be detectable by reading a single physical quantity and should not require comparison of two different quantities, which would involve the use of more advanced electronic systems and mapping thereof, requiring particularly expensive components and accordingly expensive calibration thereof.

Even when using constant voltage-controlled electromechanical actuators, in which the current absorbed by the actuator provides a reliable reading of the force exerted thereby, absorbed current detection requires high cost sensors, as well as high cost control unit components to analyze the absorbed and detected current value.

Furthermore, when the arm has a substantially straight motion, the electromechanical actuators designed to impart this motion are also costly, as they are typically composed of a rotary motor and a rack or recirculating-ball screw transmission.

If constant-flow hydrostatic actuators are alternatively used, in which the hydrostatic fluid pressure in the pressure chamber is directly proportional to the force exerted by the actuator, other drawbacks occur.

A first drawback of this solution is that hydrostatic actuators require a hydraulic station to supply hydraulic pressure, even in machines that would not require it as such, such as most light industrial automation machines, typically operated by compressed air.

Furthermore, the hydraulic circuit has to be controlled by solenoid valves which in turn require an electronic controller to be connected thereto, thereby increasing construction costs.

In addition, the detection of hydraulic pressure in the pressure chamber of the actuator requires electronic pressure transducers, which are also expensive, as well as expensive electronic components for interpreting the signals generated by these transducers.

Finally, a further drawback of the prior art in general is that an operator is required to manually hold the actuation control to move an operating arm to a predetermined position.

OBJECTS OF THE INVENTION

One object of the invention is to improve the state of the art.

Another object of the invention is to provide a fluid-dynamic circuit that allows accurate control of the movements of an operating arm of a machine tool, both in terms of speed and in terms of strength of the contact force between a work tool mounted to the operating arm and an object to be worked upon by the tool.

A further object of the invention is to provide a fluid-dynamic circuit that can reduce the manufacturing costs of the machine on which it is mounted.

Another object of the invention is to provide a fluid-dynamic circuit that allows predetermined movements to be performed by an operating arm without requiring an operator to hold a control as the operating time is being displaced.

In one aspect the invention relates to a fluid-dynamic circuit comprising: a source of a pressurized fluid; distributor valve means for distributing said pressurized fluid to transport lines; a feeding line for feeding said pressurized fluid, which is interposed between said source and said valve means; at least one main user apparatus which is reciprocatingly operated by actuator means which comprise a slider slideably and sealably fitted in a sliding seat of a containing element divided thereby into a first chamber and a second chamber in opposite positions and having variable volumes; and at least one second and one third transport lines for said pressurized fluid, which are interposed between said distributor valve means and said first chamber and second chamber respectively, wherein a first derived transport line is interposed between said valve means and at least one of said second and third transport lines, and has normally closed quick discharge means mounted thereto, whose opening is designed to be controlled by actuator means.

Therefore, the invention affords the following advantages:

controlling the speed and length of the stroke of an operating arm driven by a fluid-dynamic actuator, thereby avoiding any violent impact between the tools supported by the operating arm and an object to be worked upon by the tools;

holding an operating control actuated in a selected work or rest position, to move an operating arm in a first direction or in a second direction opposite thereto;

preventing any overrun of the operating arm, caused by inertia or by clearances between the components of an operating machine having the operating arm mounted thereto.

BRIEF DESCRIPTION OF THE DRAWINGS

Further characteristics and advantages of the invention will be more apparent from the detailed description of preferred, but non-exclusive embodiments of a fluid-dynamic circuit of the invention, which are described as non-limiting examples with the help of the annexed drawings, in which.

DESCRIPTION OF ONE EMBODIMENT OF THE INVENTION

Figure 1:
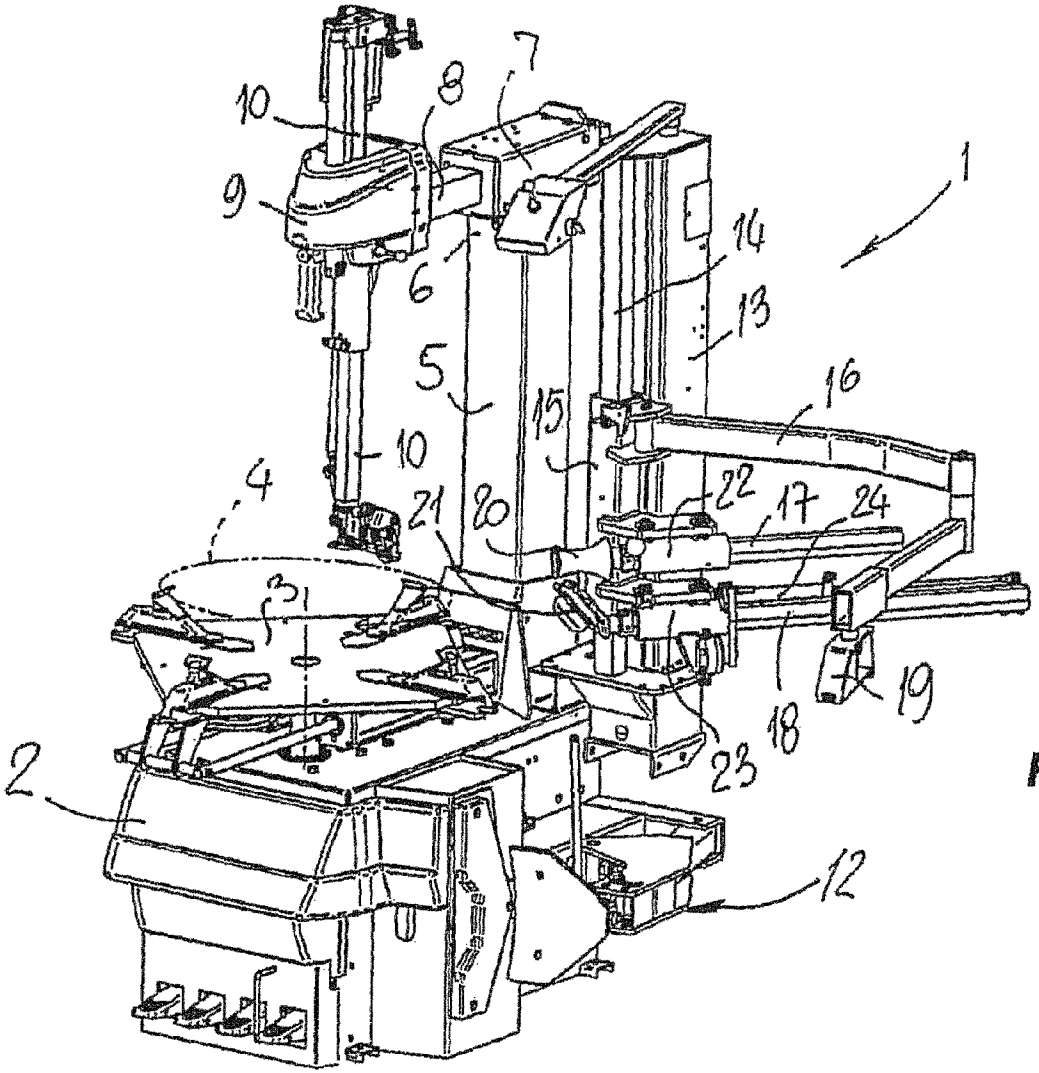
FIG. 1 is a general view of a tire demounting machine having a fluid-dynamic circuit of the invention mounted thereto.

Referring to the above figures, same reference numerals will be used to designate common parts in all the versions as shown in FIGS. 1 to 11.

Referring to FIG. 1, a tire demounting machine, generally designated by numeral 1, is shown which usually comprises a base 2 with a turntable 3 mounted thereto for supporting and locking wheels 4 to be worked upon, better known (and referred to hereinafter) as "self-centering turntable" 3.

A first pillar 5 extends in a substantially vertical direction from the base 2 and supports at its upper end 6 a guide element 7, in which a quadrangular-section bar 8 is slideably received.

The bar 8 has a support head 9, at one end facing toward the self-centering turntable 3, for receiving a hexagonal post 10 in a special inner seat, which post is coupled with the inner seat with a single degree of freedom, like the bar 8 relative to its guide element 7.

In practice, the post 10 and the first pillar 5 are substantially parallel.

A bead removing device 12 is mounted at one side of the base 2, for removing tire beads, once they have been deflated, from the edges of the rims on which they are mounted.

Next to the first pillar 5, a second pillar 13 is mounted to the base 2, parallel to the first pillar 5 and with carriages 15 sliding therealong on guides 14, for supporting a series of operating arms 16, 17 and 18 which have, at their ends facing toward the self-centering turntable 3, corresponding tools 19, 20, 21 for use to work upon the wheels 4.

As shown in FIG. 1, the arms 17 and 18 slide within respective guide elements, referenced 22 and 23 a linear actuator 24 being visible, thanks to the viewing angle of the figure, for slidingly driving the arm 18 in its guide element 23.

Figure 2:
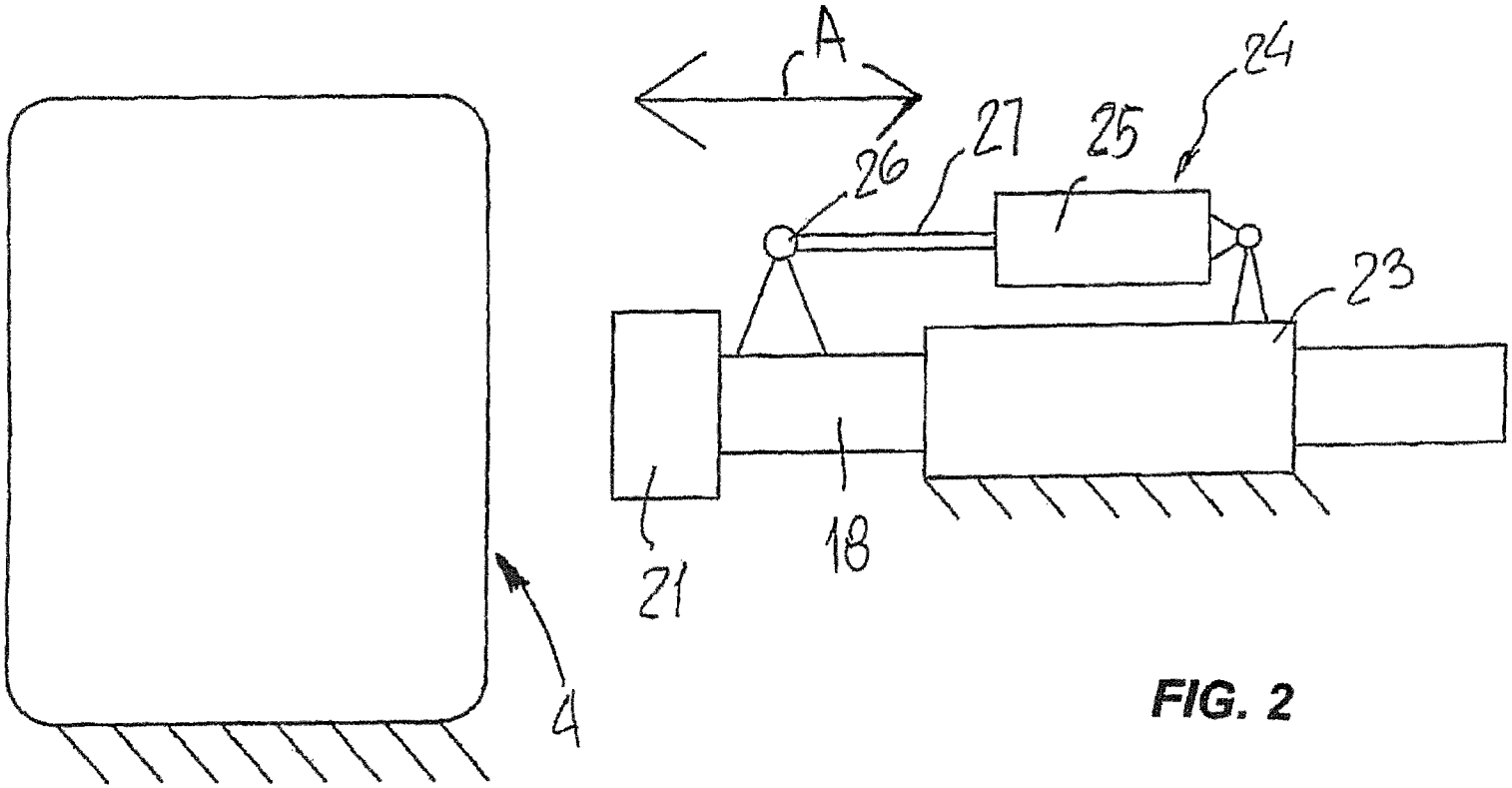
FIG. 2 is a very schematic view of an operating arm that supports a working tool to be put in contact with an object to be worked upon thereby, using a fluid-dynamic circuit of the invention.

Referring to FIG. 2, a schematic, enlarged view shows the arm 18 that slides in the guide element 23, driven by the linear actuator 24, in which an end of the jacket 25 is attached to the guide element 23 and an end 26 of a shaft 27 of a piston (not shown), sliding in the jacket 26 is attached to the arm 18.

The action of the actuator 24 moves or retracts the arm 18, equipped with a tool 21, toward or away from an object, e.g. a wheel 4, that has to be contacted to be worked upon thereby.

Figure 3:
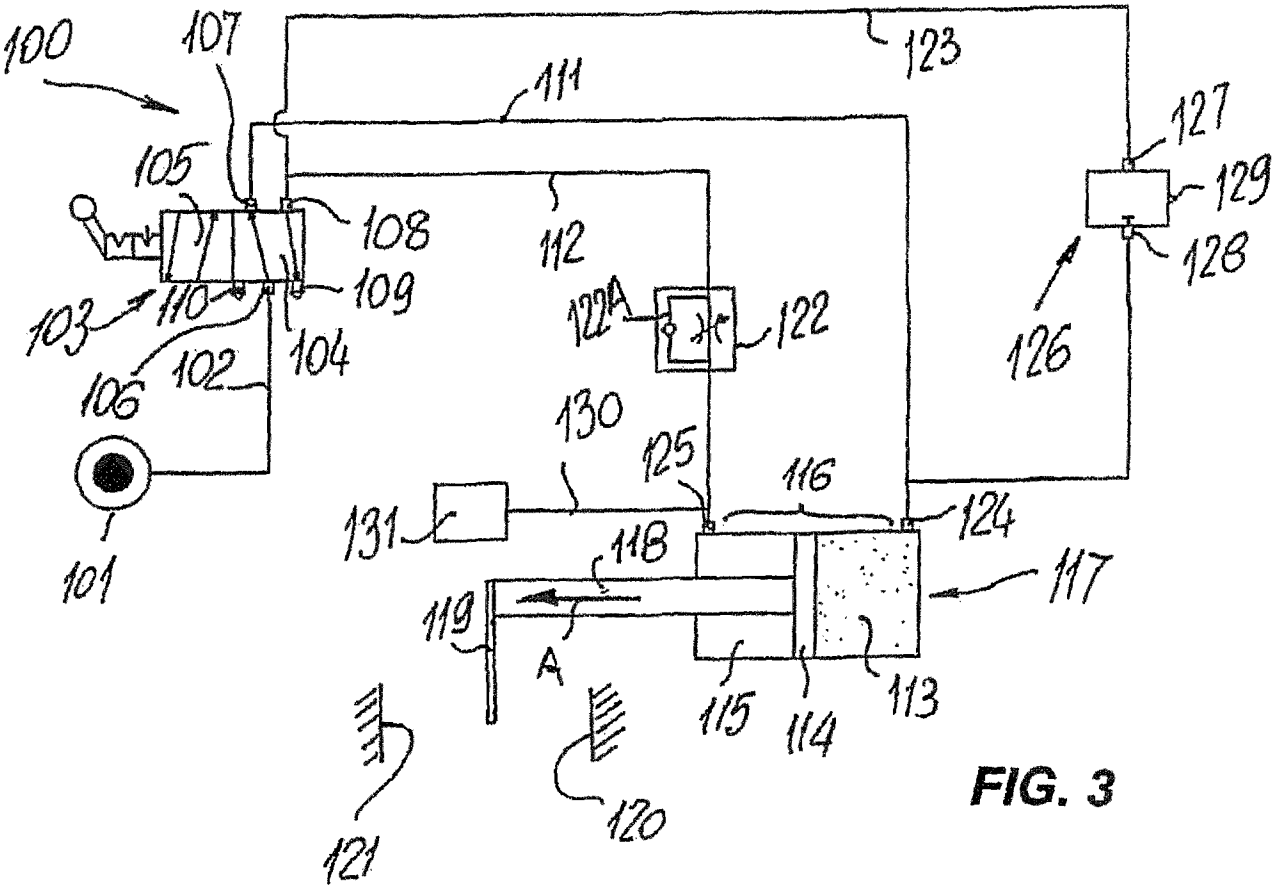
FIG. 3 is a schematic view of a first possible basic embodiment of a fluid-dynamic circuit of the invention, in a configuration in which a linear actuator for moving an operating arm of the tire demounting machine of FIG. 1 is moving away from a limit stop element.

Referring to FIG. 3, there is shown a first embodiment of a fluid-dynamic circuit, namely a pneumatic circuit, of the invention, which will be referred to below as circuit 100.

As shown in FIG. 3, the circuit 100 comprises a compressed-air source 101 which feeds compressed air through a feeding line 102 to a slide valve 103 having two work positions adapted to be selected and held stable after selection, which are referenced 104 and 105 respectively, and five access ports as a whole, namely a first port 106 for coupling to the feeding line 102, a second portion 107 for connection to one end of a second compressed-air transport line 111, a third port 108 for connection to one end of a third compressed-air transport line 112 and fourth and fifth discharge lines, referenced 109 and 110 respectively.

As is shown, the second transport line 111 is connected at its opposite end to a first chamber 113 of a sliding seat of a piston 114 which divides the seat, generally referenced 116, into this and an opposite second chamber 115.

In practice, the piston 114 and the seat 116 are part of a main user apparatus, i.e. the linear actuator 24, which comprises a pneumatic cylinder 117 having a shaft 118 which, in this case, coincides with the shaft 27, and having one end extending out of the seat 116 and with a contact element 119 mounted thereto for abutment against one of two limit stop elements 120 or 121 according to the direction of displacement of the piston 114 in the seat 116.

In this first version of the circuit 100, a flow regulator 122 is mounted along the third transport line 112 and is namely designed to regulate the compressed-air flow along the second transport line 112 in one direction, i.e. toward the second chamber 115, whereas in the opposite direction the flow is free.

A first derived transport line 123 is connected to the second transport line 111, and has a first coupling end proximate to the third port 108 and a second connection end proximate to an inlet port 125 that allows access to the first chamber 113.

The second chamber 115 also has its access port, referenced 125 with the concurrent end of the third transport line 112 connected thereto.

Quick discharge means 126 are arranged along the first derived line 123, which are designed to be normally closed, but may be opened when air pressure in the first derived line 123 increases, as further discussed below.

The quick discharge means 126 have a port 127 for connection to the first derived line 123, a port 128 for connection to the second transport line 111 and a quick discharge port 129.

A second derived line 130 is provided on the third transport line 112, namely between the flow regulator 122 and the access port 125, and connects it to an auxiliary control circuit 131, which is designed to control at least one additional user apparatus controlled by said main user apparatus, i.e. the linear actuator 24, and described below.

Figure 4:
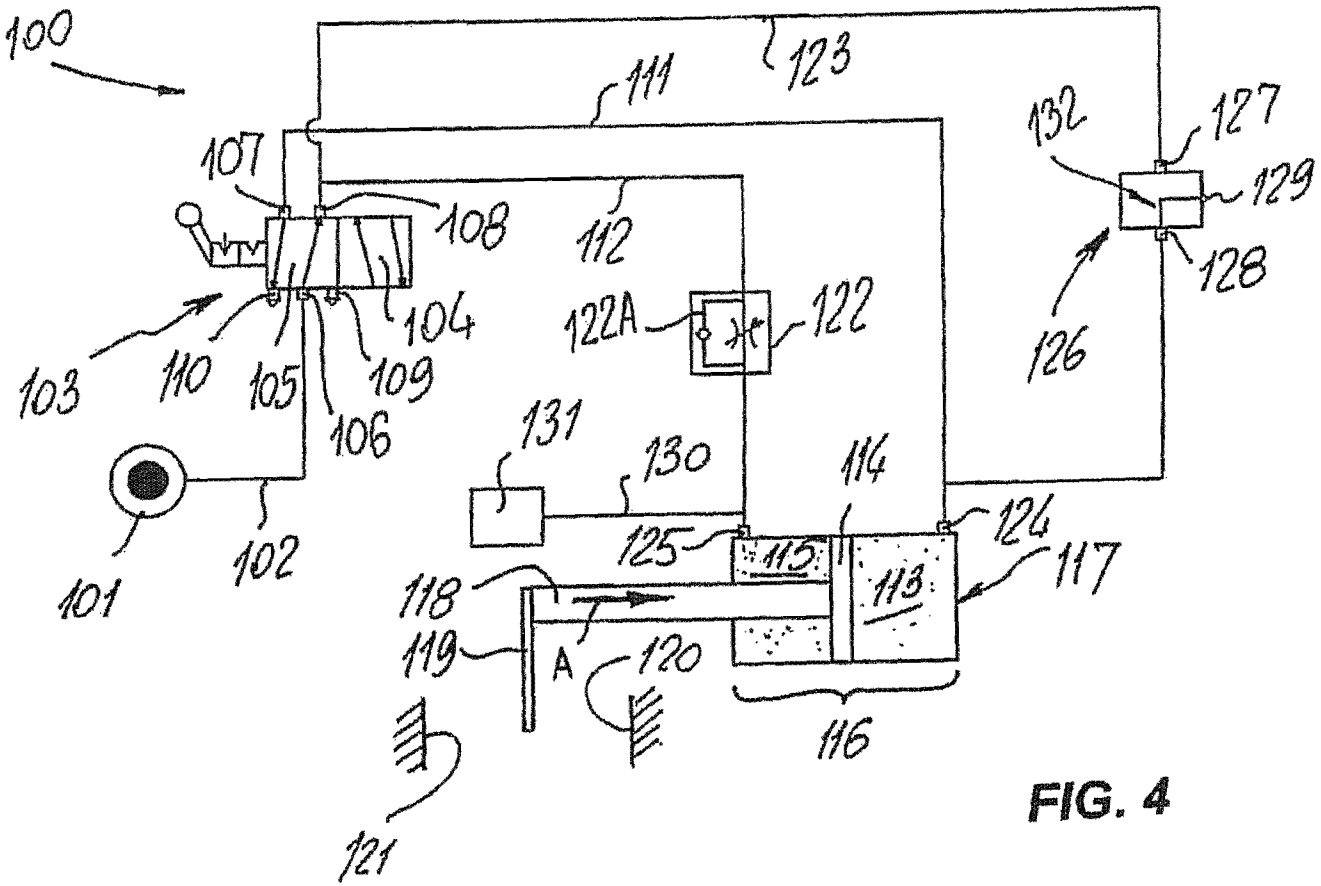
FIG. 4 is the same schematic view as FIG. 3 in another configuration in which a linear actuator for moving an operating arm of the tire demounting machine of FIG. 1 is moving toward a limit stop element.
Figure 5:
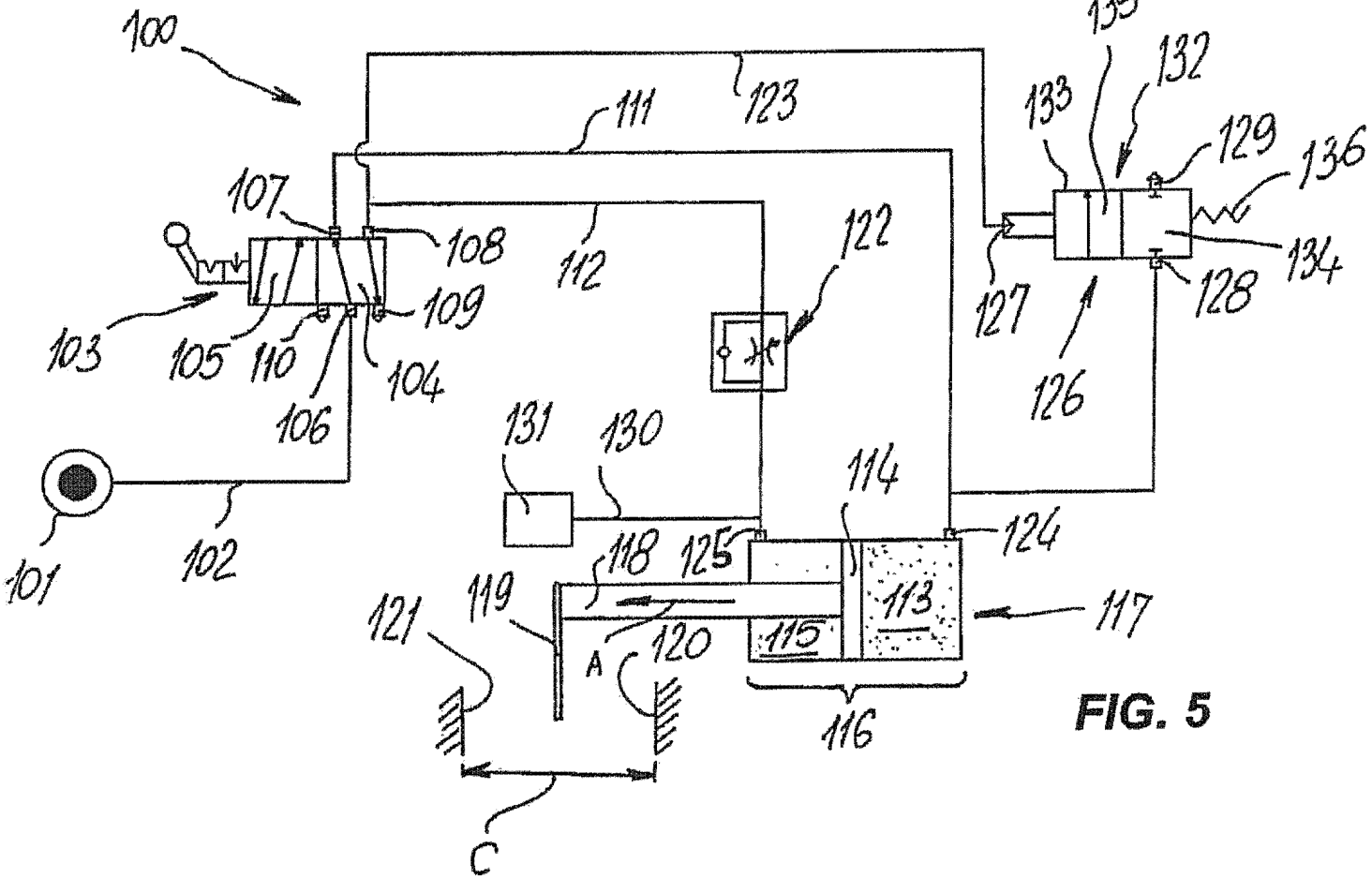
FIG. 5 is still the same schematic view of FIG. 3, showing a possible embodiment of quick discharge means mounted to a first derived transport line for pressurized fluid.

Referring now to FIG. 4, the quick discharge means 126 are shown in an open quick discharge state, as the port 128 is connected to the port 129 by means of a connection 132 that is shown in detail in FIG. 5.

In this case, the connection 132 is obtained by means of a slide valve 133 that has two alternate work positions, namely a normal position 134 in which it is closed, and a discharge position 135 in which it is open, against elastic counteracting means 136.

Furthermore, in FIG. 5, C designates the stroke that the contact element 119 may run with the shaft 118 of the piston 114.

Figure 6:
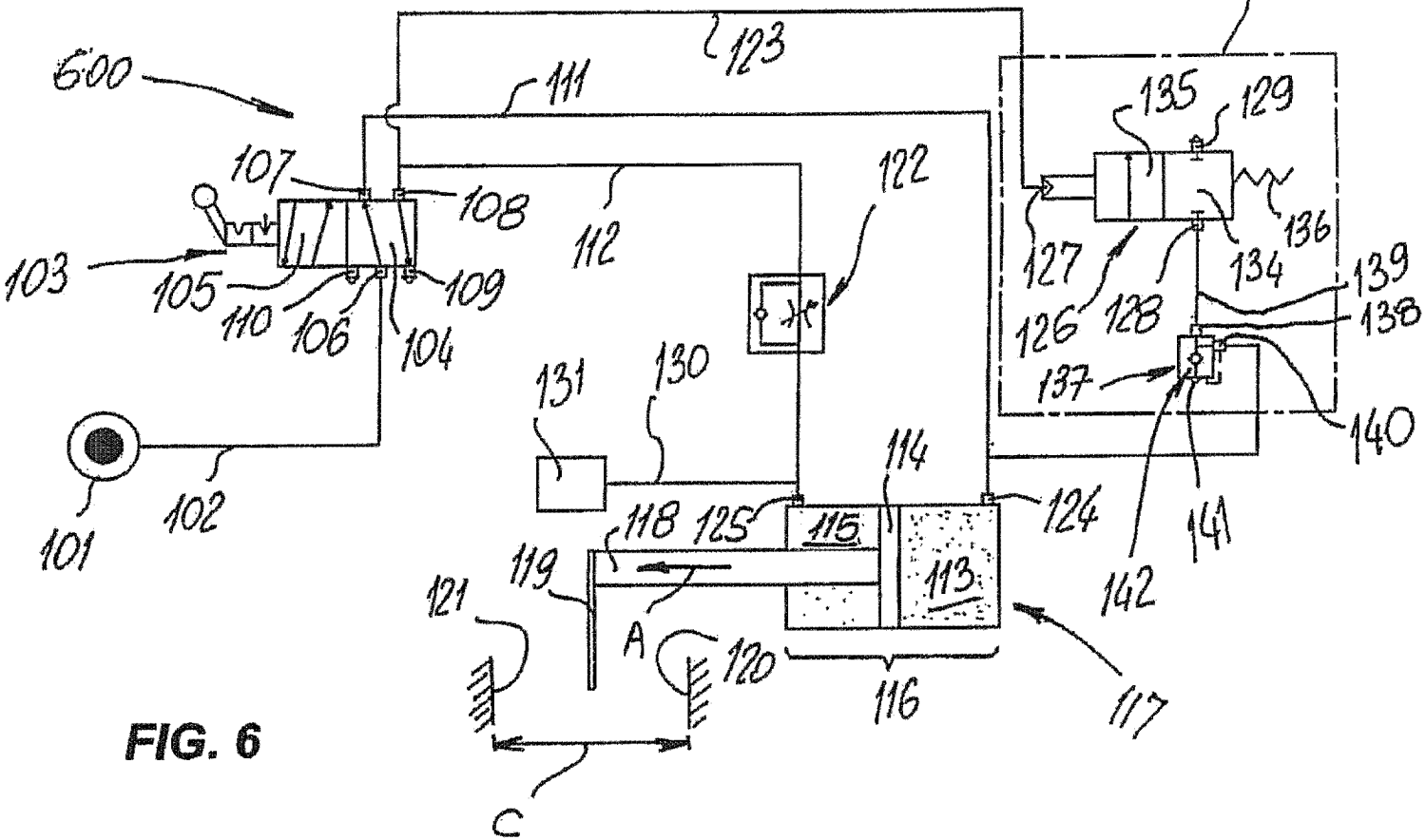
FIG. 6 is still the same schematic view of FIG. 3, in which the quick discharge means are formed according to a second possible embodiment.

Referring now to FIG. 6, in which the fluid-dynamic circuit is referenced 600, to distinguish it from the one referenced 100 in FIGS. 1 to 5, the quick discharge means 126, enclosed in broken lines, are shown in a slightly different embodiment from the one of the previous version of FIG. 5 and namely the port 128 is no longer directly connected to the second transport line 111, but to an additional quick discharge valve, generally reference 137, which is in turn connected to the second transport line 111.

In greater detail, the additional quick discharge valve 137 comprises an inlet port 138 which is connected to the port 128 of the quick discharge means 126 by means of a pneumatic connection line 139, an exit port 140 which is connected to the second transport line 111 and a discharge port 141.

The additional quick discharge valve 137 also comprises therein a connection line between the inlet port 138 and the discharge port 141, which is regulated by a one-way valve 142.

Figure 7:
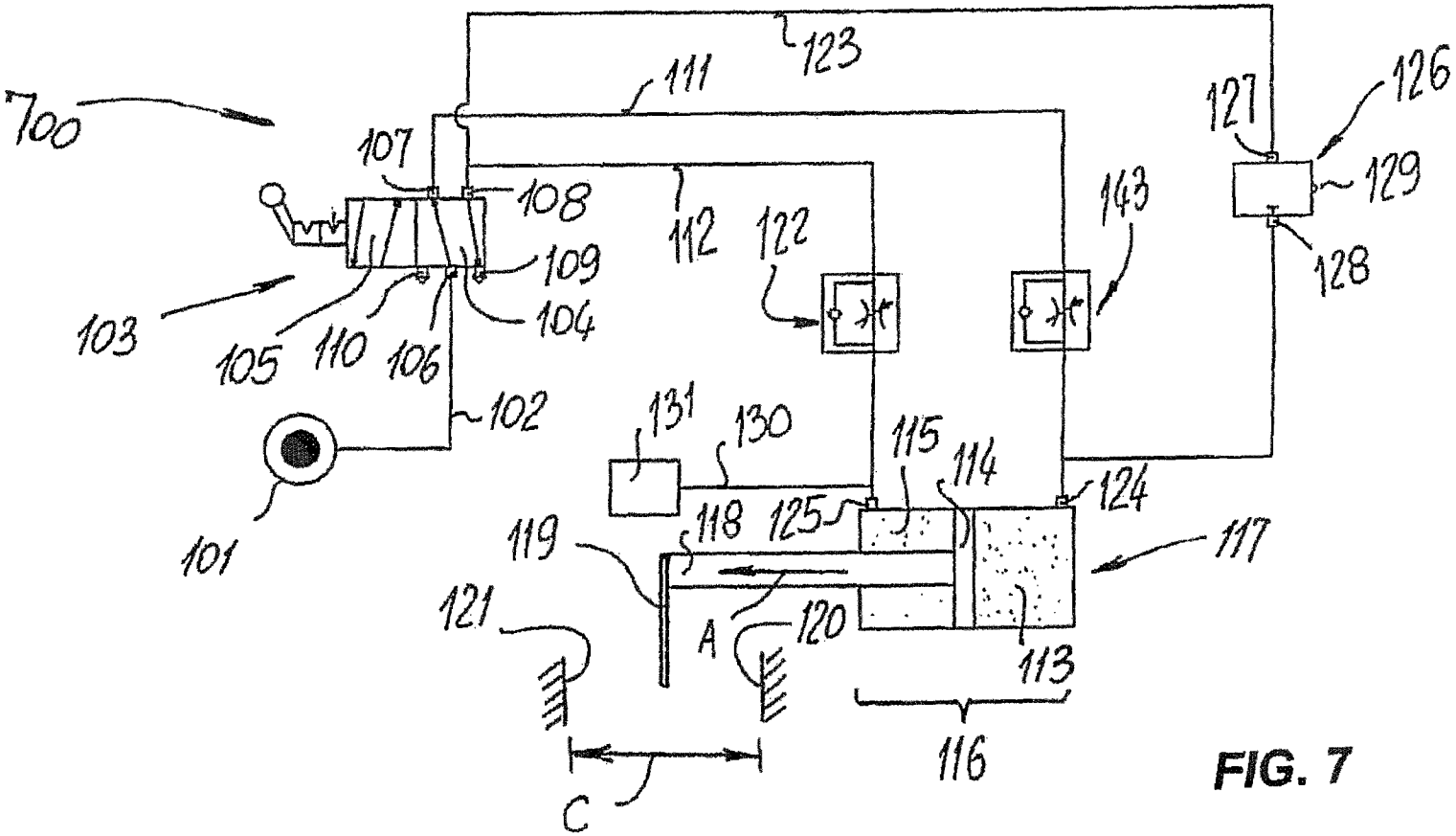
FIG. 7 is a schematic view of a more complete version of the fluid-dynamic circuit of the invention.

Referring now to FIG. 7, the fluid-dynamic circuit, here referenced 700, is substantially identical to the version of FIG. 3, referenced 100, with the only difference that an additional flow regulator 143 is also mounted to the second compressed-air transport line 111.

Figure 8:
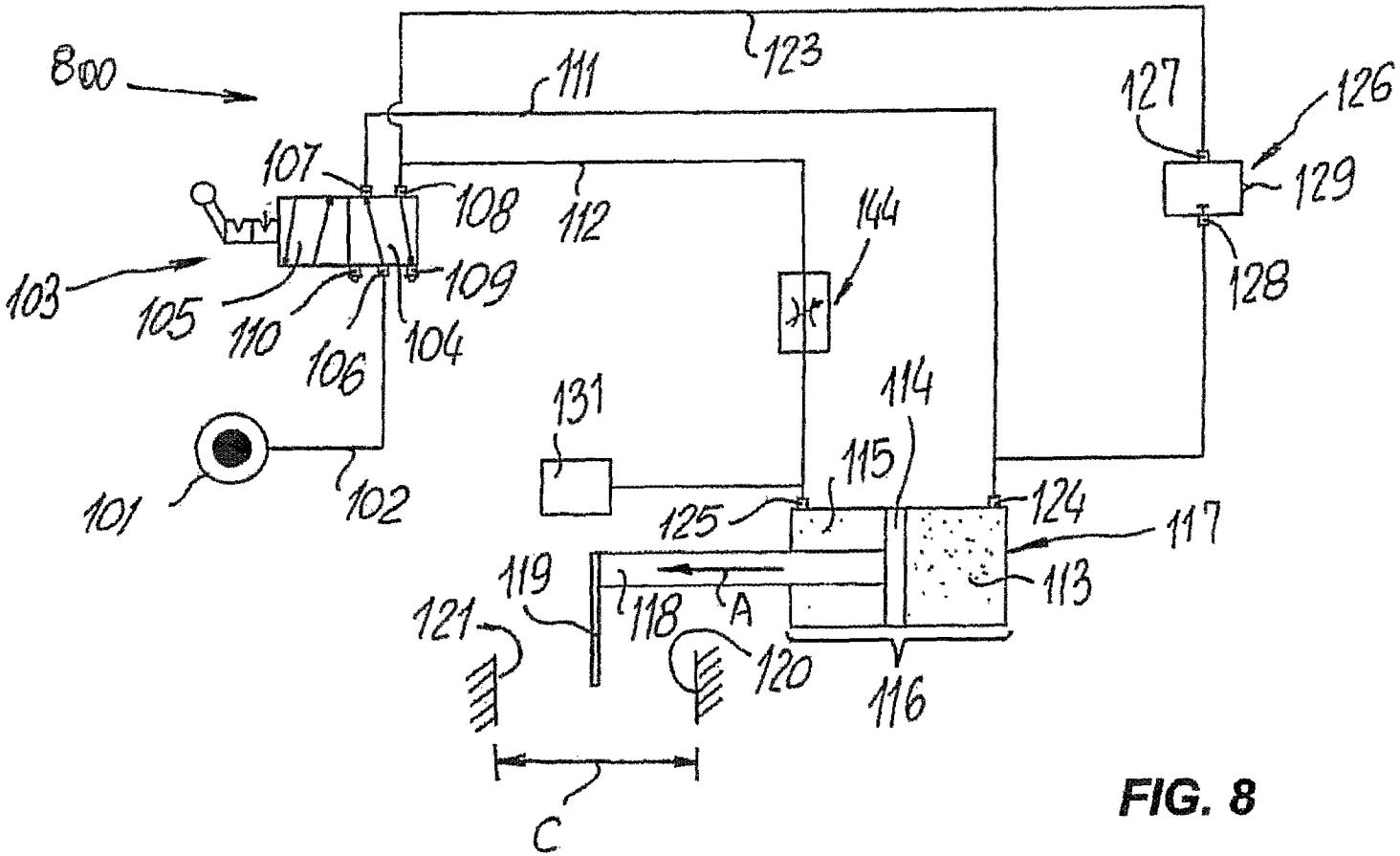
FIG. 8 is a schematic view of a version of the fluid-dynamic circuit alternative to the basic version of FIG. 3.

Referring now to FIG. 8, the fluid-dynamic circuit, here referenced 800, is also substantially identical to the version of FIG. 3, referenced 100, with the only difference that the one-way flow regulator 122 has been replaced by a two-way flow regulator 144 which may be a fixed-flow or variable-flow regulator.

Figure 9:
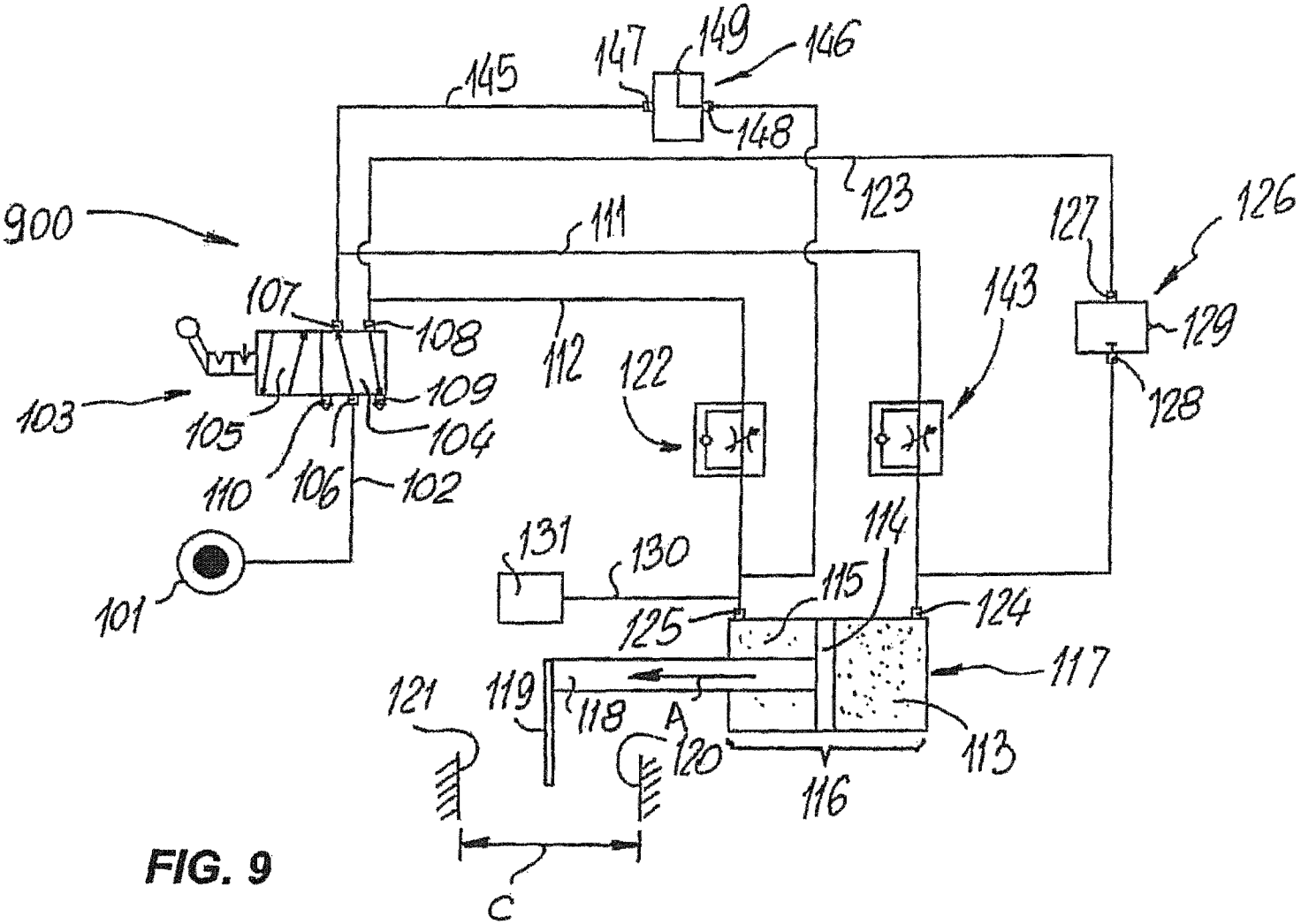
FIG. 9 is a further more complete version of the fluid-dynamic circuit of the invention, in a condition of motion away from a limit stop element.

Referring to FIG. 9, the fluid-dynamic circuit, here referenced 900, is substantially identical to the version of FIG. 7, referenced 700, with the difference that a third derived line 145 has been added, which is interposed between the second port 107 of the slide valve 103, or also between the second transport line 111 and the third transport line 112.

Namely, the end of the third derived line 145 opposite to the end for connection to the second port 107 is connected to the third transport line 112 at one point between the flow regulator 122 and the inlet port 125 of the second chamber 115.

This third derived line 145 also has further quick-discharge means 146 mounted thereto, which are substantially similar to the quick-discharge means 126, and have an inlet port 147, an exit port 148 and a discharge port 149.

As shown in FIG. 9, the exit port 148 and the discharge port 149 are in a possible connected configuration.

Figure 10:
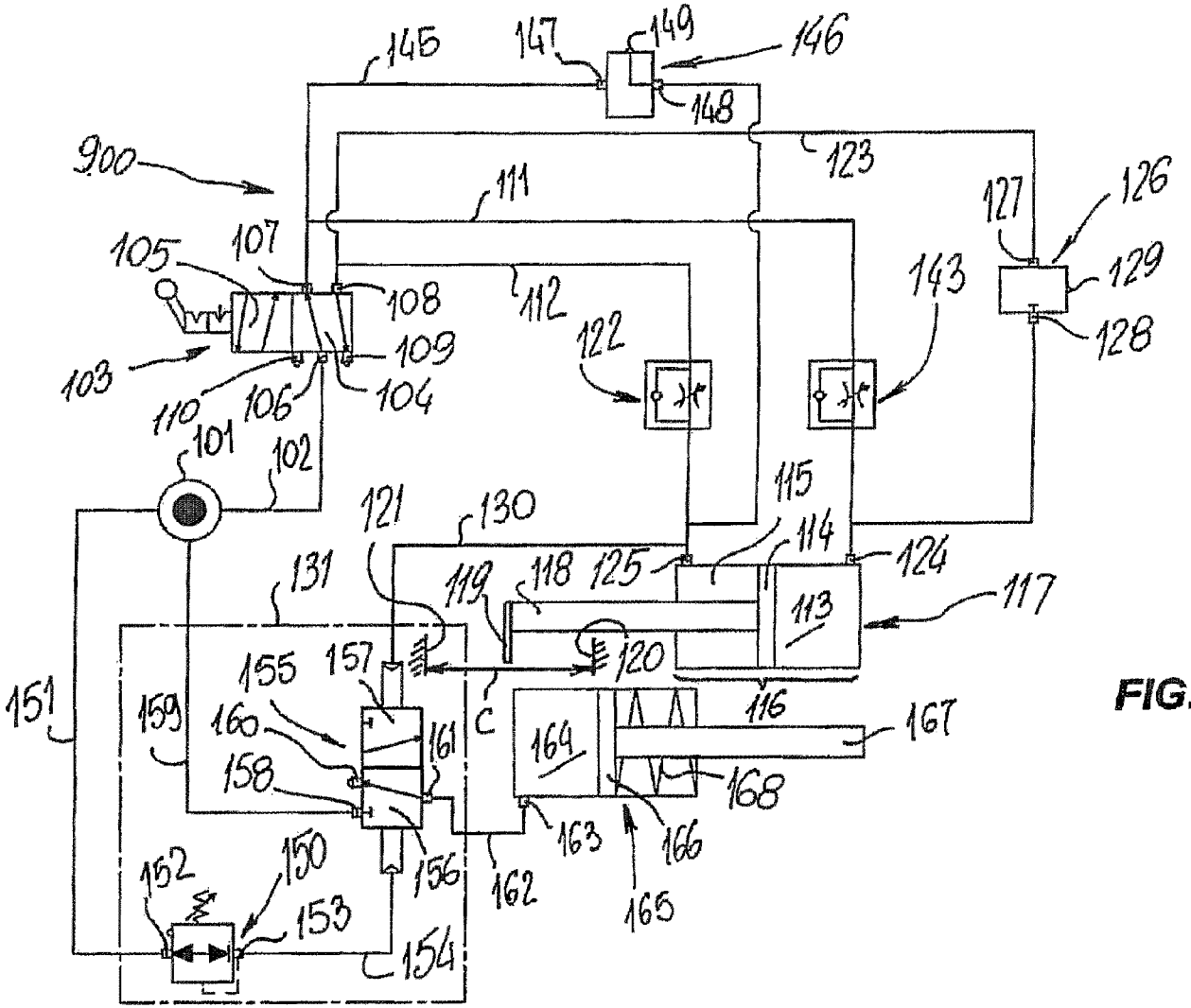
FIG. 10 is the same schematic view as FIG. 9, which shows in detail a controlled user apparatus that can be operated by the circuit of the invention.

Referring to FIG. 10, the circuit 900 is the same as the one of FIG. 9, but in this FIG. 10 the auxiliary control circuit 131, which is delimited by broken lines, is shown in a possible embodiment.

More in detail, the auxiliary control circuit 131 comprises a pressure stabilizer 150, which is mounted to a second pressurized-fluid feeding line, referenced 151, which connects the source 101 to an inlet port 152 of the pressure stabilizer 150, the latter also having an exit port 153 connected, through an additional transport line 154 for pressurized fluid, to one end of an additional slide valve 155.

The latter has two work positions 156 and 157, an inlet port 158, which is connected to the source 101 through an additional transport line 159, a discharge port 160 and an exit port 161 which is connected through an additional transport line 162 to a port 163 that provides access to a sliding chamber 164 of a linear actuator 165.

The latter has a piston 166, which is slideably mounted in the sliding chamber 164 and has a shaft 167 extending out of it.

The piston 166 slides in the sliding chamber 164 against the action of the elastic counteracting means, i.e. a compression spring 168.

Figure 11:
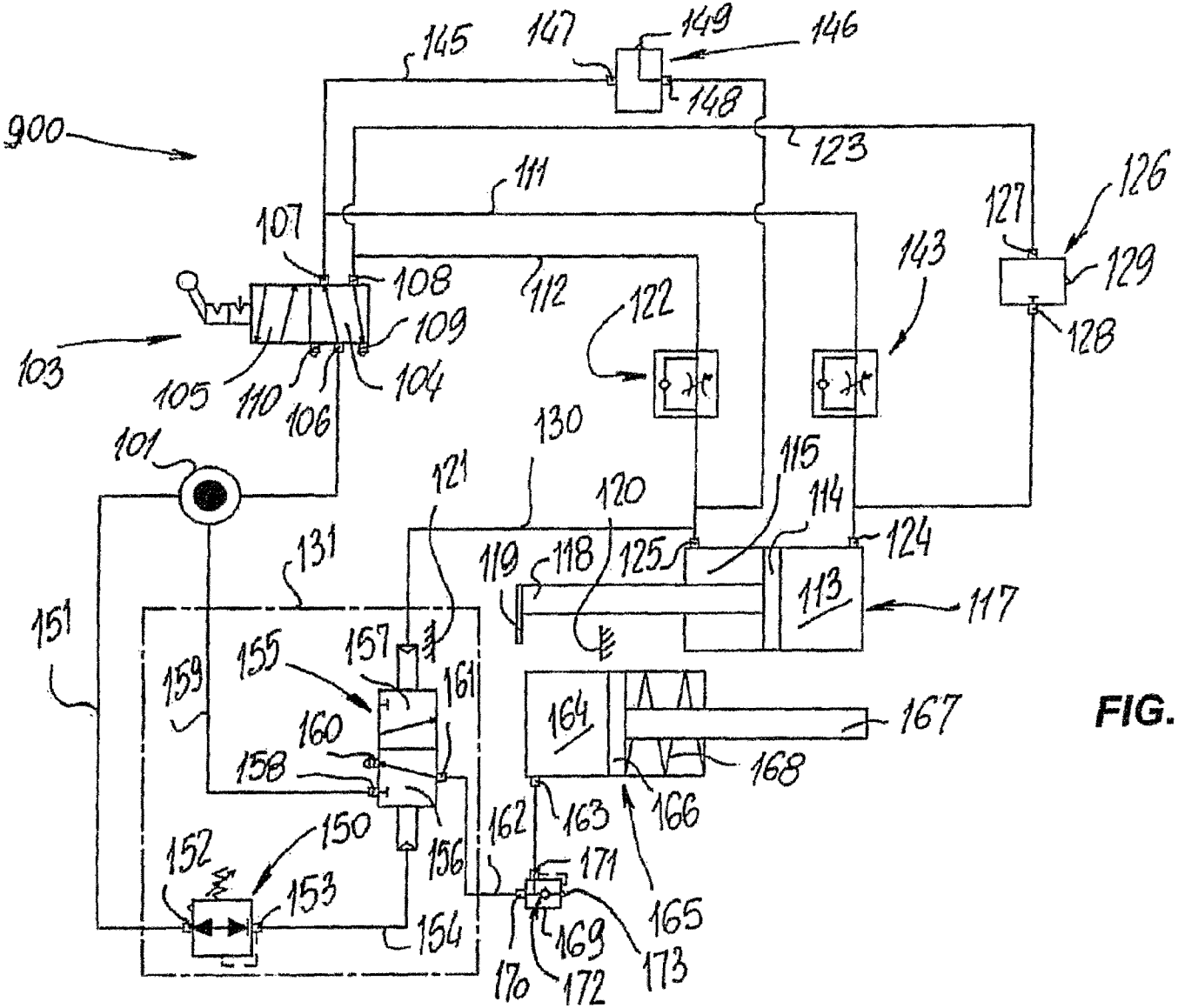
FIG. 11 is a further possible version of the scheme of the fluid-dynamic circuit of FIG. 10.

Referring to FIG. 11, the fluid-dynamic circuit 900 of FIG. 10 is shown again, with the only difference that an additional quick-discharge valve 169 is mounted to the transport line 162, between the exit port 161 of the slide valve 155 and the access port to the sliding chamber 164, which additional valve is wholly identical to the quick-discharge valve 137 described above and, like the latter, has an inlet port 170 and an exit port 171, interconnected by a connection line with a one-way valve 172 mounted thereto, and a discharge port 173.

The operation of the fluid-dynamic circuit in the versions referenced 100, 600, 700, 800, 900 is described below, a "forth" motion being understood as the motion of the contact element 119 toward the limit stop element 120 and a "back" motion being understood as the motion of the contact element toward the limit stop element 121.

Therefore, in the first case, the operating arm 18 moves toward a wheel 4, whereas in the second case it retracts from it.

Referring to the version of the fluid-dynamic circuit 100 as shown in FIG. 3, the configuration of the slide valve 103 is the one in which the arm 18 is retracted from the wheel 4.

More in detail, the operator has stably selected the work position 104 and the compressed air fed from the source 101 passes through the feeding line 102 and is conveyed into the second transport line 111, which carries it into the first chamber 113, through the inlet port 124 thereof.

Therefore, the pressure in the first chamber 113 increases and pushes the piston 114 toward the limit stop element 121.

At the same time, the second chamber 115 appears to be in an air emptying configuration, as it is connected to the fourth discharge port 109 through the third transport line 112 and a by-pass 122A belonging to the flow regulator 122.

In this work configuration, the first derived line 123 is also connected to the fourth discharge port 109 and hence no pressurized air reaches the quick discharge means 126, which hence remain in a closed state.

In this work configuration, the sliding speed of the piston 114 is controlled by the pressure differential between the first and second chambers 113 and 115.

Referring to FIG. 4, the version of the fluid-dynamic circuit 100 is the same as shown in FIG. 3, but in a work position opposite to the previous one.

The operator has actuated the slide valve 103 by stably moving it to the work position 105.

In this configuration, the compressed air supplied from the source 101 through the first coupling port 106 and the second connection port 108 is simultaneously conveyed into the third transport line 112 and the first derived line 123.

Through the third transport line 112, pressurized air moves past the flow regulator 122 that has a flow regulating function and is introduced into the half-chamber 115.

The second transport line 111 is connected both to the fifth discharge port 110 through the second connection port 107 and to the quick-discharge means 126 through the connection port 128 thereof.

As shown in FIGS. 4 and 5, air pressure in the first derived line 123 provides connection between the quick-discharge port 129 of the quick-discharge means 126 and the connection port 128.

Pressure acts on the connection port 127 and moves the quick-discharge means 126 into the discharge position 135, by overcoming the counteracting force of the elastic means 136, namely the compression spring 136.

In this configuration, the time for emptying the half-chamber 113 is much shorter than the time for filling the second camber 115.

Therefore, the piston 114 (and hence the operating arm 18) moves toward the limit stop element 120 at a speed controlled by the section of the passage of the flow regulator 122.

Once the contact element 119 has abutted against the limit stop element 120 and hence the operating arm 18 has carried the tool 21 to the proper work position relative to the wheel 4, pressure in the second chamber 115 starts to increase until it reaches a predetermined adjustable threshold that operates the auxiliary control circuit 131, the latter actuating, in this case, the linear actuator 165, as shown in FIG. 10 which shows a configuration opposite to the actuating configuration, but still provides some understanding of the operation of the auxiliary control circuit 131, with the help of the following description.

In more detail, the pressure of compressed air in the second chamber 115 acts upon the additional slide valve 155 through the second derived line 130 and switches it to the work position 157.

When the slide valve 155 is in this work position 157, as shown in FIG. 10, the inlet 158 and exit 161 ports of the slide valve 155 are connected to each other.

Therefore, the pressurized air that comes from the source 101 through the additional transport line 15 and passes into the additional transport line 162 is introduced into the sliding chamber 164 of the linear actuator 165.

Pressure acts upon the piston 166, which compresses the counteracting spring 1269 and moves toward it.

The shaft 167 of the piston 166 conforms, or is connected to, a stop pin (not shown), which is designed to fit into, or be extracted from a corresponding seat (also not shown) formed in the arm 18, transverse to the direction of movement of the latter, as designated by the arrow "A" in FIG. 2, and to also pass through an opening accordingly formed in the guide element 23, thereby forming, as a whole, a block for stopping the sliding motion of the arm 18 relative to the latter.

Referring to FIG. 6, the additional quick-discharge valve 137 allows very quick release of the pressure in the first chamber 113, when the slide valve 103 is set by the operator in the work position 105 and the first derived line 123 carries pressurized air toward the quick-discharge means 126.

These switch into the work position 135 and the two connection 128 and quick-discharge 129 ports are connected to each other.

This causes the one-way valve 142 to open and the exit port 140 to be directly connected with the discharge port 141 of the quick-discharge valve 137: such connection allows discharge of the first chamber 113 which is emptied very quickly, thereby affording a controlled-speed travel of the piston 114 toward the limit stop element 120.

Referring to the fluid-dynamic circuit 700 as shown in FIG. 7, each of the second and third transport lines 111 and 112 is equipped with a flow regulator 122 and 143.

This allows the displacement speeds of the piston 114 to be controlled in both directions, i.e. both toward the limit stop element 120 and toward the limit stop element 121 because, depending on the work position 104 or 105 of the slide valve 103, compressed air is fed to the first chamber 113 or the second chamber 115 in a gradual manner, by adjusting the sections of the passages, and hence the flow rates, of the flow regulators 122 and 143.

In the fluid-dynamic circuit version 800 as shown in FIG. 8, both the supply of compressed air to the second chamber 115, which causes the operating arm 18 to move toward the wheel 4 and the discharge thereof from such second chamber 115, which causes the arm 18 to move away from the wheel 4, are controlled by the two-way flow regulator 144, which allows control of both the forward and back stroke speeds of the piston 114, by slowing down the entry of compressed air and the exit of compressed air from the second chamber 115.

Referring to the fluid-dynamic circuit version 900 as shown in FIG. 9, a third derived line 145 is also provided on the third transport line 112 and has additional quick-discharge means 146 mounted thereto which ensure quick discharge of the second chamber 115, when pressurized air flows in the third derived line 145, i.e. like in the configuration as shown in FIG. 9, just as it occurs in the first chamber 113 when the slide valve 103 is set by the operator to the work position 105.

When the second chamber 115 is set to quick discharge, it is quickly emptied, while the first chamber 113 is progressively filled with pressurized air, whose flow is regulated, as mentioned above, by the flow regulator 143.

In practice, in the fluid-dynamic circuit version 900, both the forward and the back strokes of the piston 114 (and hence the arm 18) have controlled speeds and are not exposed to interferences caused by resistances which, in prior art fluid-dynamic circuits, are produced by temporarily residual pressures in the emptying half-chamber.

Referring to FIG. 11, the operation is substantially as described for the circuit 900 of FIG. 9.

However, when the additional slide valve 155 is in the work position 156 as shown in the figure, the additional quick-discharge valve 169 allows quick discharge of the sliding chamber 164 of the linear actuator 165, by retracting the shaft 167 from the position in which the sliding motion of the arm 18 is stopped, as described above.

It can be noted that, in this work position, the discharge 160 and exit 161 ports of the additional slide valve 155 are connected to each other.

Therefore, the additional transport line 162 is connected in a discharge configuration through the discharge port 160, and the one-way valve 172 opens and provides direct connection between the exit port 171, with the access port 163 to the sliding chamber 164 connected thereto, and the discharge port 173.

The above disclosed invention was found to fulfill the intended objects.

The invention is susceptible to a number of changes and variants within the inventive concept.

Furthermore, all the details may be replaced by other technically equivalent parts.

In practice, any materials, shapes and sizes may be used as needed, without departure from the scope of the following claims.

What is claimed is:

1. A fluid-dynamic circuit comprising:

(a) a source of a pressurized fluid;

(b) distributor valve means arranged for distributing said pressurized fluid to transport lines;

(c) a feeding line of said pressurized fluid arranged between said source and said distributor valve means;

(d) at least a main user apparatus which is movably actuated by actuating means which comprise a slider slidingly and sealingly fitted in a sliding seat of a containing element which is divided by the slider into a first chamber and a second chamber reciprocally opposed and both having variable volumes; and (e) at least a second and a third transport lines of said pressurized fluid interposed between said distributing valve means and said first chamber and second chamber respectively, wherein between said valve means and at least one of said second and third transport lines a first derived transport line is arranged along which quick discharge means normally closed and having an actuatable opening by actuating means are mounted, and wherein said quick discharging means comprise a second slide valve having two working positions and three access ports, a first port being connected to said first derived transport line, a second port being connected to a quick discharge, a third port being connected to one of said second and third transport lines, said slide valve being maintained in a position in which said second port is maintained normally closed by contrast elastic means.

2. A fluid-dynamic circuit according to claim 1, wherein said actuating means comprise an actuating pressure of said pressurized fluid.

3. A fluid-dynamic circuit according to claim 2, wherein said actuating pressure comprises a pressure of said pressurized fluid conveyed in said first derived transport line.

4. A fluid-dynamic circuit according to claim 1, wherein said valve means comprise at least a first slide valve having two alternative working positions and at least five access ports, a first port being connected to said feeding line, a second port being connected to said second transport line, a third port being connected to said third transport line, a fourth and a fifth ports being connected to a discharge.

5. A fluid-dynamic circuit according to claim 1, wherein at least a flow control apparatus is mounted on at least one of said second and third transport lines to control its flow.

6. A fluid-dynamic circuit according to claim 5, wherein between said control apparatus and main user apparatus an auxiliary control circuit is interposed, suitable to control at least a user apparatus controlled by said main user apparatus.

7. A fluid-dynamic circuit according to claim 6, wherein said at least controlled user apparatus comprises blocking means of movements of said main user apparatus according to preselected positions.

8. A fluid-dynamic circuit according to claim 5, wherein said control apparatus comprises a throttle element chosen between a mono-directional element and a bi-directional element.

9. A fluid-dynamic circuit according to claim 1, wherein said main user apparatus comprises at least one operative arm of a machine, which is associated to said slider and has one of its ends protruding outside from said sliding seat which is equipped with working tool means.

10. A fluid-dynamic circuit according to claim 9, wherein said one end protruding outside comprises contact means suitable to contact at least one limit stop element.

11. A fluid-dynamic circuit according to claim 1, wherein between both said second and third transport lines and said distributor valve means the respective first derived line and a respective second derived line are provided, quick discharging means normally closed and having a controlled opening being mounted on both said first derived line and second derived line.

12. An apparatus characterized in that it comprises a fluid-dynamic circuit according to claim 1.

13. An apparatus according to claim 12, wherein said apparatus comprises a tire demounting machine equipped with an operative tools holder arm which can be actuated to-and-fro a preselected working point by the fluid-dynamic circuit according to claim 1.

14. A fluid-dynamic circuit comprising:

(a) a source of a pressurized fluid;

(b) distributor valve means arranged for distributing said pressurized fluid to transport lines;

(c) a feeding line of said pressurized fluid arranged between said source and said distributor valve means;

(d) at least a main user apparatus which is movably actuated by actuating means which comprise a slider slidingly and sealingly fitted in a sliding seat of a containing element which is divided by the slider into a first chamber and a second chamber reciprocally opposed and both having variable volumes; and (e) at least a second and a third transport lines of said pressurized fluid interposed between said distributing valve means and said first chamber and second chamber respectively, wherein between said valve means and at least one of said second and third transport lines a first derived transport line is arranged along which quick discharge means normally closed and having an actuatable opening by actuating means are mounted, wherein said quick discharging means comprise a second slide valve having two working positions and three access ports, a first port being connected to said first derived line, a second port being connected to a quick discharge, a third port being connected to one of said second and third transport lines, said slide valve being maintained in a position in which said second port is maintained normally closed by contrast elastic means, wherein at least a flow control apparatus is mounted on at least one of said second and third transport lines to control its flow, wherein between said control apparatus and main user apparatus an auxiliary control circuit is interposed, suitable to control at least a user apparatus controlled by said main user apparatus, wherein said at least controlled user apparatus comprises blocking means of movements of said main user apparatus according to preselected positions, and wherein said auxiliary circuit comprises:

further valve means equipped with a distributor sliding between two working positions and which can be actuated by pressure differences acting on opposed surfaces of said distributor;

a fourth pressurized fluid transport line which connects one of said opposed surfaces of the distributor to the source of pressurized fluid;

a fifth transport line which connects the other of said opposed surfaces of the distributor to one of the second and third transport lines;

a discharging port;

an inlet port of pressurized fluid connected to the source of pressurized fluid by a sixth transport line; and an exit port connected to the blocking means.

* * * * *